US005950896A

United States Patent [19]

Theodore

[11] Patent Number: 5,950,896

[45] Date of Patent: Sep. 14, 1999

[54] MULTI-PURPOSE THORACIC SAC

[76] Inventor: Dean Anthony Theodore, 26821 West Sage Ct., Calabasas Hills, Calif. 91301

[21] Appl. No.: 09/123,539

[22] Filed: Jul. 28, 1998

Related U.S. Application Data

[60] Provisional application No. 60/074,036, Feb. 9, 1998.

[51] Int. Cl.[6] ..... A45F 3/04

[52] U.S. Cl. ..... 224/647; 224/637; 224/642; 224/648; 224/651; 224/657

[58] Field of Search ..... 224/646, 647, 224/648, 649, 642, 637, 640, 651, 657

[56] References Cited

U.S. PATENT DOCUMENTS

| | | | |
|---|---|---|---|
| D. 370,090 | 5/1996 | Coggins | D30/109 |
| 4,434,920 | 3/1984 | Moore | 224/160 |
| 4,480,775 | 11/1984 | Stanford | 224/210 |
| 4,985,458 | 1/1991 | Linday | 224/160 |
| 4,986,458 | 1/1991 | Linday | 224/648 |
| 5,020,709 | 6/1991 | Hoaglan | 224/151 |
| 5,040,524 | 8/1991 | Votel et al. | 224/649 |
| 5,178,309 | 1/1993 | Bicheler et al. | 224/153 |
| 5,361,952 | 11/1994 | Gold | 224/159 |
| 5,366,126 | 11/1994 | Dausien | 224/211 |
| 5,586,703 | 12/1996 | Radar et al. | 224/646 |
| 5,603,441 | 2/1997 | Easter | 224/647 |

*Primary Examiner*—Stephen P. Garbe
*Attorney, Agent, or Firm*—Richard C. Litman

[57] ABSTRACT

A multi-purpose thoracic sac for carrying personal belongings or the like is disclosed. The multi-purpose thoracic sac or front pack with its unique and versatile structures, such as a removable padded seat cushion, bilateral insulated pouch with velcro closure, therapeutic and strategically placed padded shoulder supports, personal safety devices, and a removable lumbar roll facilitate and improve energy conservation, comfort, and sitting posture. The front pack of the present invention enhances overall posture which in turn alleviates lordosis, scoliosis, kyphosis, back-packer's palsy, chronic back pain or strain and provides the user with a sense of security and comfort.

10 Claims, 5 Drawing Sheets

MULTI-PURPOSE THORACIC SAC

CROSS-REFERENCE TO RELATED APPLICATION

This application claims the benefit of U.S. Provisional patent application Ser. No. 60/074,036, filed Feb. 9, 1998.

BACKGROUND OF THE INVENTION

1. Field of the Invention

The present invention generally relates to shouldered, carrying bags for holding personal items. More specifically, the invention relates to a multi-purpose pack that is worn over the chest of a wearer so as to improve a user's overall posture.

2. Description of Related Art

Various packs, especially the back packs, are well known in the related art. However, the back packs promote poor posture because a wearer is normally hunched forward in an attempt to compensate for the weight on the wearer's back. The wearer's shoulders are internally rotated asymmetrically and elevated abnormally. The wearer's neck is flexed and protracted forward. The wearer's vision is limited because of the position of the back pack forces the wearer to focus downwardly, instead of looking straight ahead. All of these problems place a tremendous pressure onto the spinal column, specifically the lumbar region, which is overly exaggerated when a back pack is worn. This over exaggeration of the lumbar region exacerbates spinal column pain by causing the spinal column to impinge on the spinal nerves. Another disadvantage of the traditional back pack is that the position of the back pack causes the wearer's chest cavity to flex and the lungs to compress, thus creating an energy loss and decreasing the wearer's endurance level. The effect of poor posture causes many people to suffer from chronic lower back pain and discomfort.

Accordingly, there is a need for a shouldered pack that is worn on the front of a wearer so as to enhance and maintain a proper posture for conserving the wearer's energy. An added benefit of such pack involves the increased sense of safety and security of one's belongings inside the pack by the ability to see the pack. Yet another benefit of such pack is to incorporate beneficial principles of a therapeutic neurodevelopmental technique which brings the wearer's pelvis into an anterior tilt, as compared to the traditional back packs which bring the pelvis into a posterior tilt. The posterior tilt of the pelvis places increased pressure onto the wearer's lumbar spine.

Exemplary packs known in the related art and described in the patent literature include U.S. Pat. No. 370,090 issued to Coggins on May 21, 1996 which describes a pet carrier bag. The bag is placed on the front region of the carrier when in use. The bag has two disconnected side zippers, one on each side, a front loop and shoulder straps. However, the bag may cause extreme discomfort because the shoulder straps are not padded. In addition, the bag does not have girth straps to secure the bag along the waist so as to minimize the weight from the shoulders and the front region. Thus, the bag, like many other back packs, may provoke poor posture to the carrier.

U.S. Pat. No. 5,366,126 issued to Dausien on Nov. 22, 1994 describes a back pack. The back pack has adjustable shoulder straps which are padded. However, the back pack does not include a waist strap to fasten the pack along the waist area of the wearer so as to alleviate postural strains which are normally caused by excess weight from the back pack.

U.S. Pat. No. 5,361,952 issued to Gold on Nov. 8, 1994 describes a baby carrier. The carrier is used for supporting the baby on the front region of the wearer and has a baby seat, a waist belt and a neck support. However, the baby carrier does not provide a safe and secured structure for its contents because it does not include a complete closure. In addition, the baby carrier does not provide an aesthetic appearance.

Moreover, frontal carriers have been the subject of much patent literature. However, each of the carriers is normally used for supporting a child, rather than for carrying personal belongings or the like. In addition, the carriers are bulky and have an open top. Such inventions are described in U.S. Pat. Nos. 5,178,309 issued to Bicheler et al. on Jan. 12, 1993, 5,020,709 issued to Hoaglan on Jun. 4, 1991, 4,986,458 issued to Linday on Jan. 22, 1991, and 4,434,920 issued to Moore on Mar. 6, 1984. The carrier in each of the literatures generally includes a waist strap, a pair of partially padded shoulder straps, and a baby seat. The baby seat has side sections and side bolsters for supporting the infant. However, none of the infant carriers provide a safety structure which completely seals the contents in the pack. Furthermore, the carrier does not provide an aesthetic appearance for such an intended use.

U.S. Pat. No. 4,480,775 issued to Hoaglan on Jun. 4, 1991 describes a front pack. The pack has a skeletal frame for supporting a mail bag, a pair of unpadded shoulder straps and a waist belt. The front pack does not include pockets and safety structure to seal one's belonging therein. In addition, the pack does not provide an effective and efficient use.

None of the above inventions and patents, taken either singly or in combination, is seen to describe the instant invention as claimed.

SUMMARY OF THE INVENTION

The present invention is a multi-purpose thoracic sac having a removable lumbar roll for carrying personal belongings or the like. This multi-purpose thoracic sac is a front pack, that is, the multi-purpose thoracic sac of the present invention is worn over the chest region of the person wearing the pack. The front pack with its unique and versatile structures, such as the therapeutic and strategically padded shoulder supports, removable padded seat cushion, bilateral insulated pouch with velcro closures, and removable lumbar roll, helps to improve an overall posture for all age groups, which in turn helps to alleviate kyphosis, chronic back pain, or strain.

In addition, the sac minimizes the occurrence of lordosis and scoliosis by encouraging and facilitating a wearer's pelvis into an anterior tilt. Moreover, the front pack alleviates a "back-packers palsy" which occurs when the brachial plexus nerve is impinged upon when wearing a back pack, thus decreasing the circulation in the arms and hands. Lastly, the front pack provides the user with a sense of security and control over the contents of the pack.

Accordingly, it is a principal object of the invention to provide an improved front pack that helps to promote proper posture and to effectively hold and retain personal items or the like within the pack.

It is another object of the invention to provide a front pack with an unobscured field of vision and with a securing means so as to tightly close the front pack.

It is another object of the invention to provide a removable padded seat cushion that is removed and used as a cushion to sit on any surface that is uncomfortable.

It is a further object of the invention to provide a safety feature so that the wearer may alert others of a hazardous situation.

Still another object of the invention is to provide an illumination means for visibility under dark or cloudy conditions.

Yet another object of the invention is to provide a pair of padded shoulder straps, which are adjustable for user comfort, and a removable lumbar roll for distributing the weight of the pack from the shoulders.

Still another object of the invention is to provide a bilateral front pouch for warming hands, or holding a wallet, or the like.

It is an object of the invention to provide an easy and convenient means to close pocket openings.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings

DETAILED DESCRIPTION OF THE PREFERRED EMBODIMENT

Figure 1:
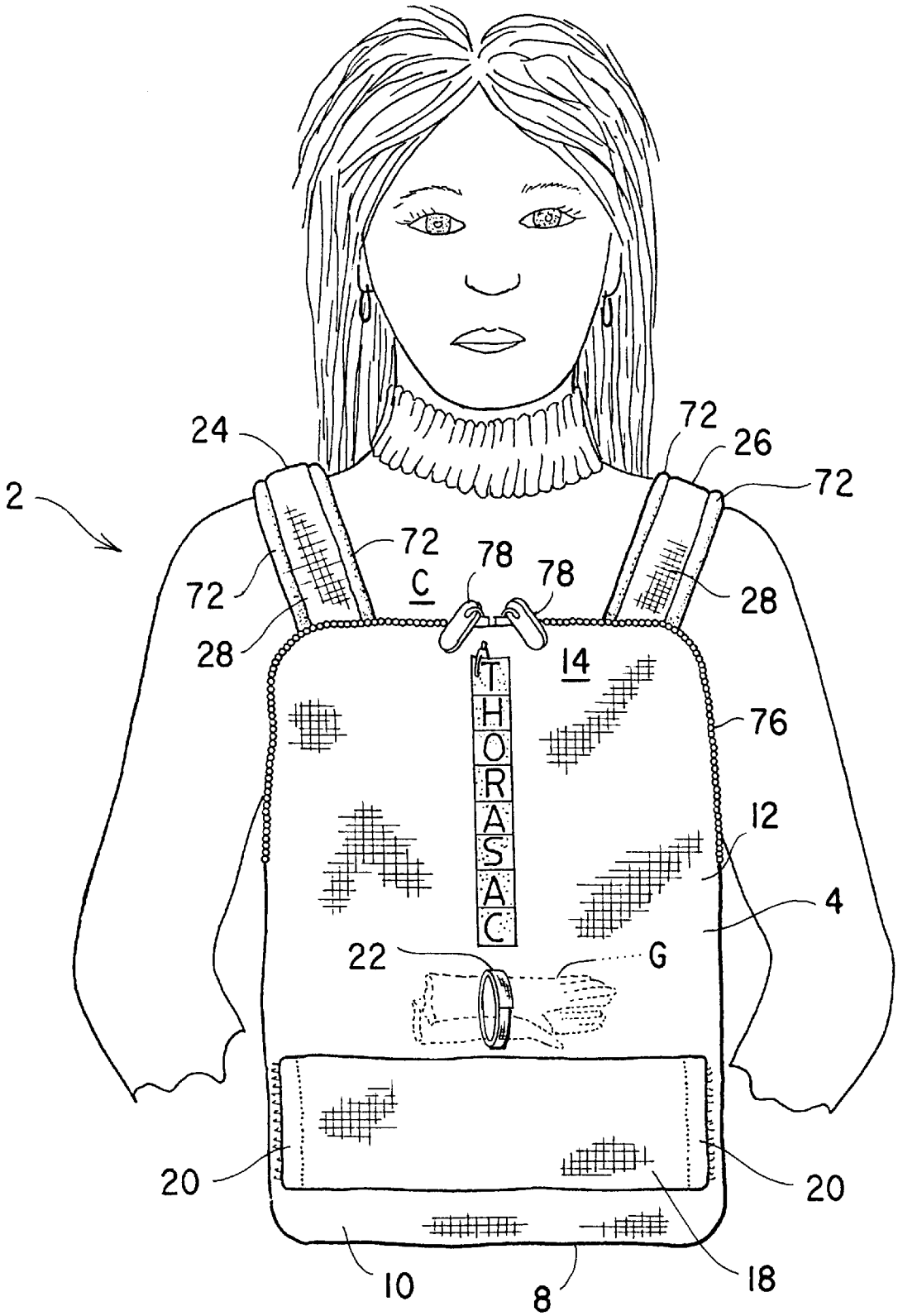
FIG. 1 is an environmental, front elevational view of a front pack according to the present invention.

Referring to the FIGS. 1, 2, 3, 4, and 5 together, the present invention is a multi-purpose thoracic sac or front pack 2 for carrying one's belonging and the like. The front pack 2 comprises a front piece 4 and a back piece 6. The front piece 4 and the back piece 6 connect with one another at the edges 8 by stitching along the bottom section 10 and then enclose the mid-section 12 and top section 14 by two continuous zippers 76 for completely sealing the front pack 2, each zipper having a zipper tag 78 for a user to easily grasp.

The front pack 2, in combination with attached internal components, provides both an overall improvement to a wearer's posture within the lumbar region of the spinal column (as described later) and in improvement in safety. These advantages arise from the front pack 2 being dimensioned and configured to be conveniently donned over the wearer's chest region C.

Focusing initially on the ancillary safety features, because the front pack 2 is donned on the chest region C, which is just below the wearer's normal forward visual field, one can minimize the risk of pickpockets, muggers, or the like from stealing his or her belongings. Hence, one can minimize anxiety, which in turn helps to improve one's health. In addition, when it rains, an umbrella will keep both the front pack 2 and its wearer dry. Moreover, the front piece 4 of the front pack 2 has reflective lettering 16 on its upper front surface. The reflective lettering 16 helps the wearer from being accidentally hit by oncoming traffic or the like in the dark.

The front piece 4 also includes a bilaterally accessible pouch 18 having an insulation layer to keep the wearer's hands warm in a cold climate. The pouch 18 has two VELCRO closures 20, one on each side, to seal the pouch 18 when not used for warming the hands. This permits the pouch 18 to be completely and safely closed and utilized as an additional storage compartment, so that a wallet or any important item may also be stored therein for ready access.

In addition, a hook and loop fastener (VELCRO) loop 22 is fixedly attached to the front surface of the front piece 4 for holding a hat or a pair of gloves G therein. The loop 22 is formed by opposing and cooperating hook and loop tapes which join to form the loop, which may be adjusted in diameter by reattaching the hook and loop tape. The loop 22 is positioned just above the pouch 18 on the front piece 4. Optionally, a pen pocket or strap (not shown) mounts to the front surface of the front piece 4.

Figure 2:
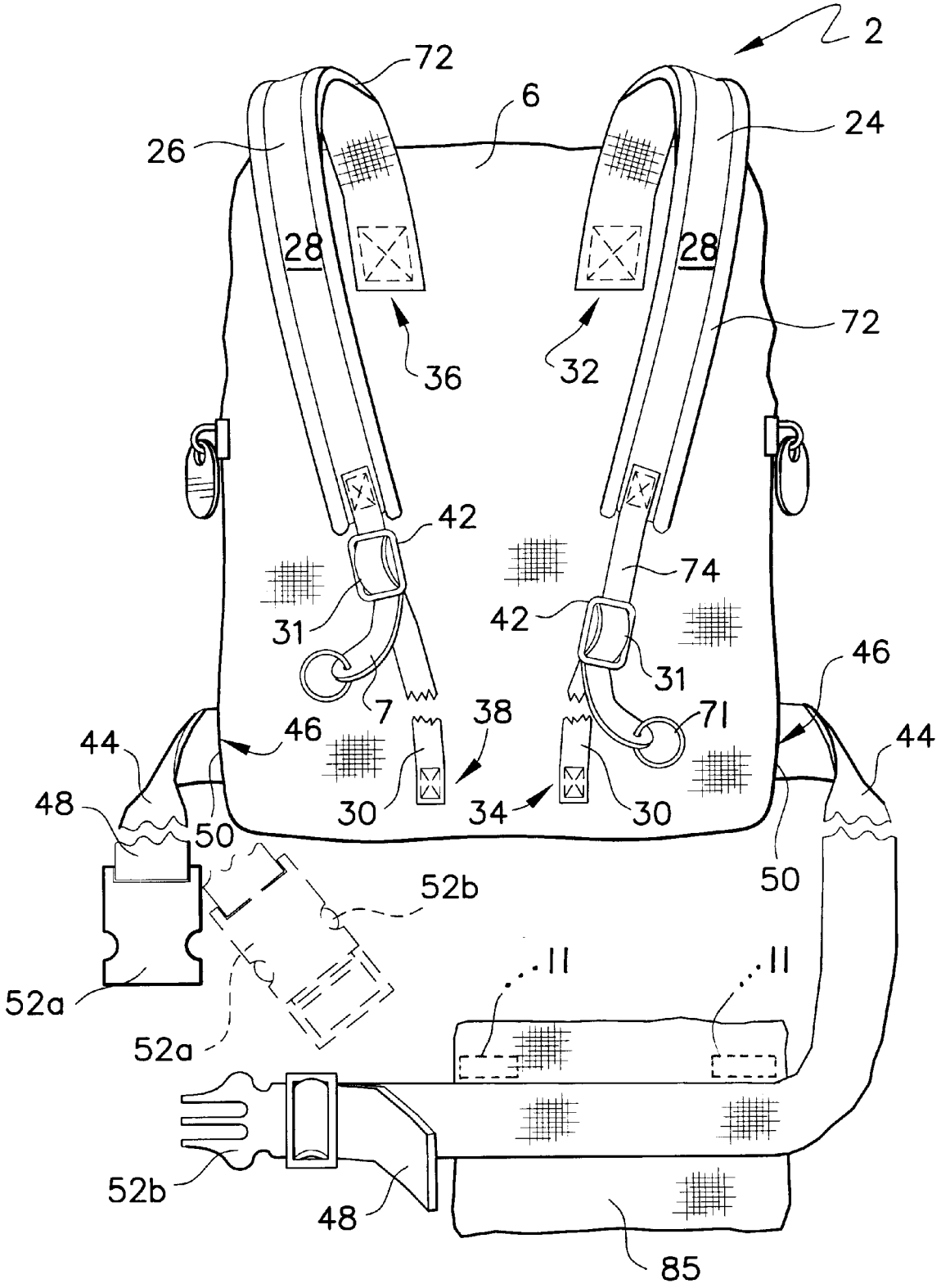
FIG. 2 is a partially fragmented and rear perspective view of the present invention showing the removable lumbar roll.

Turning now to the means by which a the front pack 2 improves posture and referring to FIG. 2, the front pack 2 includes a first and a second adjustable shoulder support 24,26 which are critically positioned over the clavicle and sternum areas. Each support 24,26 is attached to the back piece 6 so that, when worn, the support 24,26 is positioned over the medial border of scapula. Each of the shoulder supports 24,26 comprise an upper part 28 and a lower part 30. The upper part 28 includes generous padding for user comfort. The upper part 28 of the first shoulder support 24 is secured to an upper left portion 32 of the back piece 6. An adjustment strap 74 attaches to each upper part 28 and cooperates with the lower part 30 to form length adjustment means. The lower part 30 is stitched and strategically attached to a lower left end portion 34 of the front pack 2 so that the upper part 28 and the lower part 30 align vertically with respect to each other.

Likewise, the upper part 28 of the second shoulder support 26 is positioned and secured to the upper right portion 36 in a similar manner as the first shoulder support 24. The upper part 28 of the second shoulder support 26 is secured along the upper right portion 36 of the front pack 2 and extends longitudinally from said upper right portion 36. The lower part 30 of the second shoulder support 26 attaches to a lower right end portion 38 of the pack 2. Each shoulder support 24 or 26 has on each side a reflective lining 72 for visibility in the dark.

To adjust the length of each support, the lower part 30 has a double loop buckle 31 attached to its first free end 40. The lower part 30 thus couples with the upper part 28 by threading the strap 74 through the double loop buckle 31 in such a way that the first free end 40 of the lower part 30 may be pulled to tighten, and thereby shorten, the shoulder support 24,26. The strap 74 may further include a toggle ring 71 for ease of pulling the strap 74 through buckle 31.

The front pack 2 further includes a pair of waist straps 44 with a removable lumbar roll 85. The lumbar roll 85 is formed by wrapping a rectangular piece of material 85 around itself to form a roll. The roll shape is maintained using hook and loop fastener (Velcro) strips 11. Thus, the lumbar roll can be removed from the waist strap 44 and used as a cushion on any seat anytime, for example, in a car, at school, in a chair, in an airplane seat. When in use as a lumbar support, the waist straps 44 extend transversely and buckle behind the lower back or lumbar region of the user. Each waist strap 44 includes a fixed end 46 and a free end 48, wherein the fixed end 46 is attached to a lower edge 50 of the pack by stitching and the free end 48 adjustably engages with one of a pair of cooperating buckle portions 52*a*,52*b*. Each of the buckle portions 52*a*,52*b* engages with one another by snapping together thereby securing the straps 44 together.

Also, the length of each strap 44 is predetermined so that the strap 44 on the right hand side is of a different, shorter length from that of the left hand side in order to accommodate the majority of people who are right dominant. This permits the buckle to be coupled at the side, rather than at the rear of the user, being thus positioned along the wearer's side for comfort and convenience. In the preferred embodiment, the right hand strap 44 ranges from 2 to 3 inches long whereas the left hand strap 44 ranges from 20 to 26 inches long. Likewise, as shown in phantom lines of FIG. 2, the relative positions of buckle portions 52*a*,52*b* may be, in the alternative, switched on the straps 44 as is convenient to left or right dominant individuals.

Thus, the advantages of the structural relationships between the removable lumbar roll 85 and adjustable supports 26,24 can now also be appreciated to include a postural control and spinal alignment so as to enhance an erect posture. In use, the wearer places the upper parts 28 of the shoulder supports 24,26 overlying the wearer's shoulders and adjusts the lower parts 30 accordingly. Thus, the shoulder supports 24,26 hang over the shoulders allowing the weight of the front pack 2 to be borne against the chest and not the back. The lumbar roll 85 helps to facilitate bringing the pelvis into an anterior pelvic tilt, instead of a posterior tilt which generally induces a poor posture and is normally provoked by conventional back packs. As the user tightens and shortens the supports 24,26 by means of pulling on toggle ring 71, a therapeutic postural pulley effect is caused wherein the lumbar roll 85 is pulled into the back. Thus, the thoracic region is pulled into an upright posture which facilitates spinal column decompression of the spinal nerves and brings the pelvis forward into an anterior tilt which improves overall spinal posture. The lumbar roll 85 thus positions the wearer so that an improvement of the overall posture, especially in the thoracic region is achieved, thus minimizing the occurrence of kyphosis, lordosis, scoliosis, collapsing of the thoracic region, back-packers palsy, spinal compression, postural strains, vertebral nerve impingement and chronic lower back pain.

Figure 3:
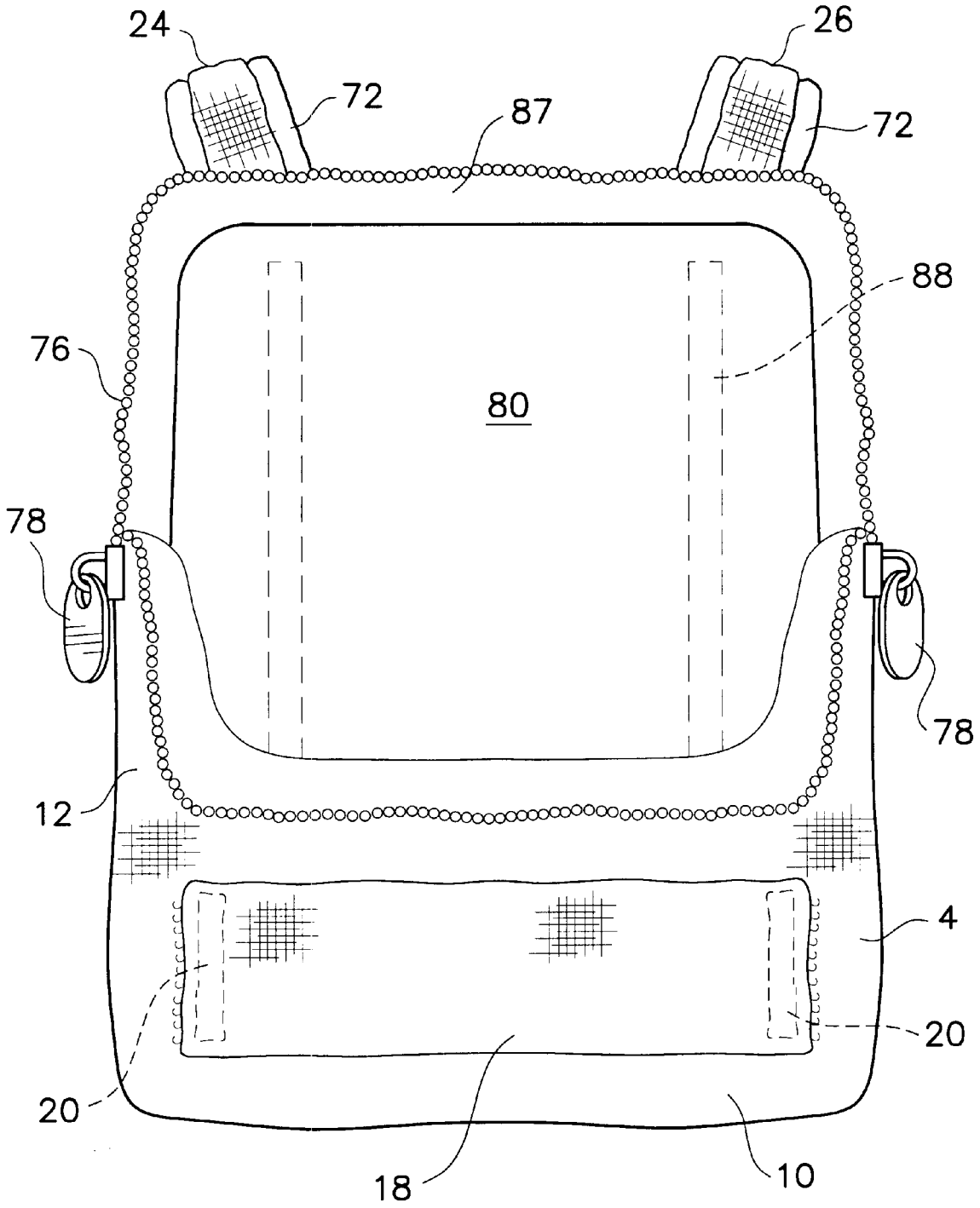
FIG. 3 is an rear view of the present invention in an open condition and depicting the removable padded seat cushion.

Turning now to additional contents of the front pack 2 and referring to FIG. 3, the drawing shows a partially opened front pack 2. Inside the front pack 2 against the rear interior surface 87 of the pack 2 is a removable padded seat cushion 80 that is attached to the rear interior surface 87 by two vertical VELCRO strips 88 on the bottom surface of the seat cushion 80. The two vertical VELCRO strips 88 extend along the length of the seat cushion 80. The seat cushion 80 can be used by children in their classroom seats to improve their posture and comfort which in turn increases their attention span. The seat cushion 80 can be used on any hard and/or dirty surface.

Figure 4:
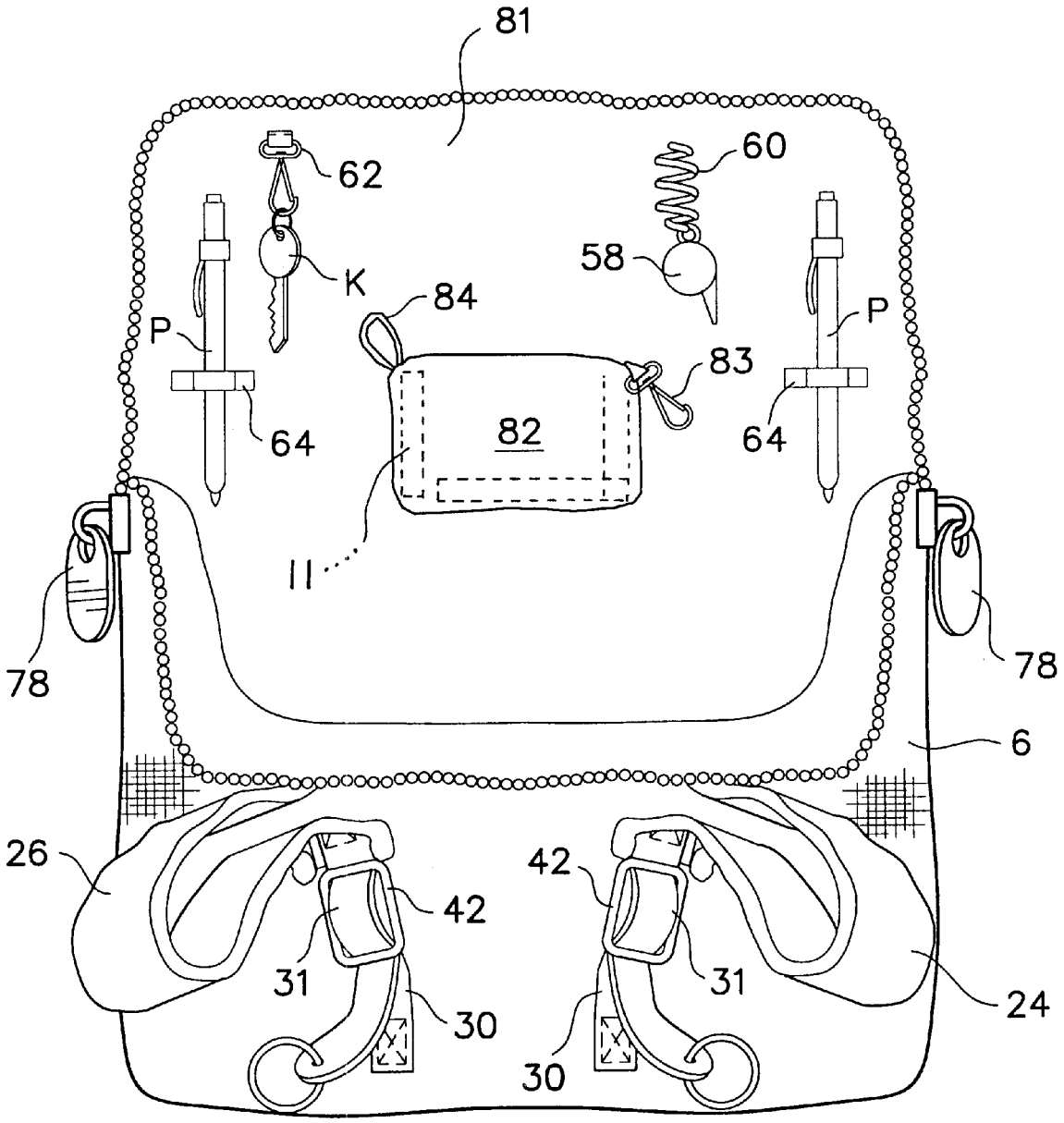
FIG. 4 is a rear view of the present invention depicting internal parts attached on the inside of a front flap.

FIG. 4 is a rear view of the front pack 2 partially unzipped revealing the interior surface 81 of the front portion of the pack 2. Inside the front pack 2, more specifically a top portion of the interior surface 81, is a fixedly attached whistle 58 that includes a string 60. The whistle 58, which generates an alarming sound, is used when the wearer feels that he or she is in danger, thus alerting others in the nearby area who can provide help. Across from the whistle 58, a key holder 62 comprising a plastic snap-hook and swivel is attached for conveniently storing a key K of the wearer. Along opposing sides, a pen holder 64 for holding a pen P or the like is provided. A removable pocket 82 with a cloth loop 84 at one end and a swivel hook 83 at the other end is placed about the mid-portion of the interior surface 81. The removable pocket 82 is secured to the interior surface 81 using a Velcro strip 11. The removable pocket 82 has a zipper closure and is provided for holding small personal items. In a preferred embodiment, the zipper (not shown) extends from the cloth loop 84 to the swivel hook 83. The interior surface 81 can be optionally provided with a pocket for housing a cellular phone.

Figure 5:
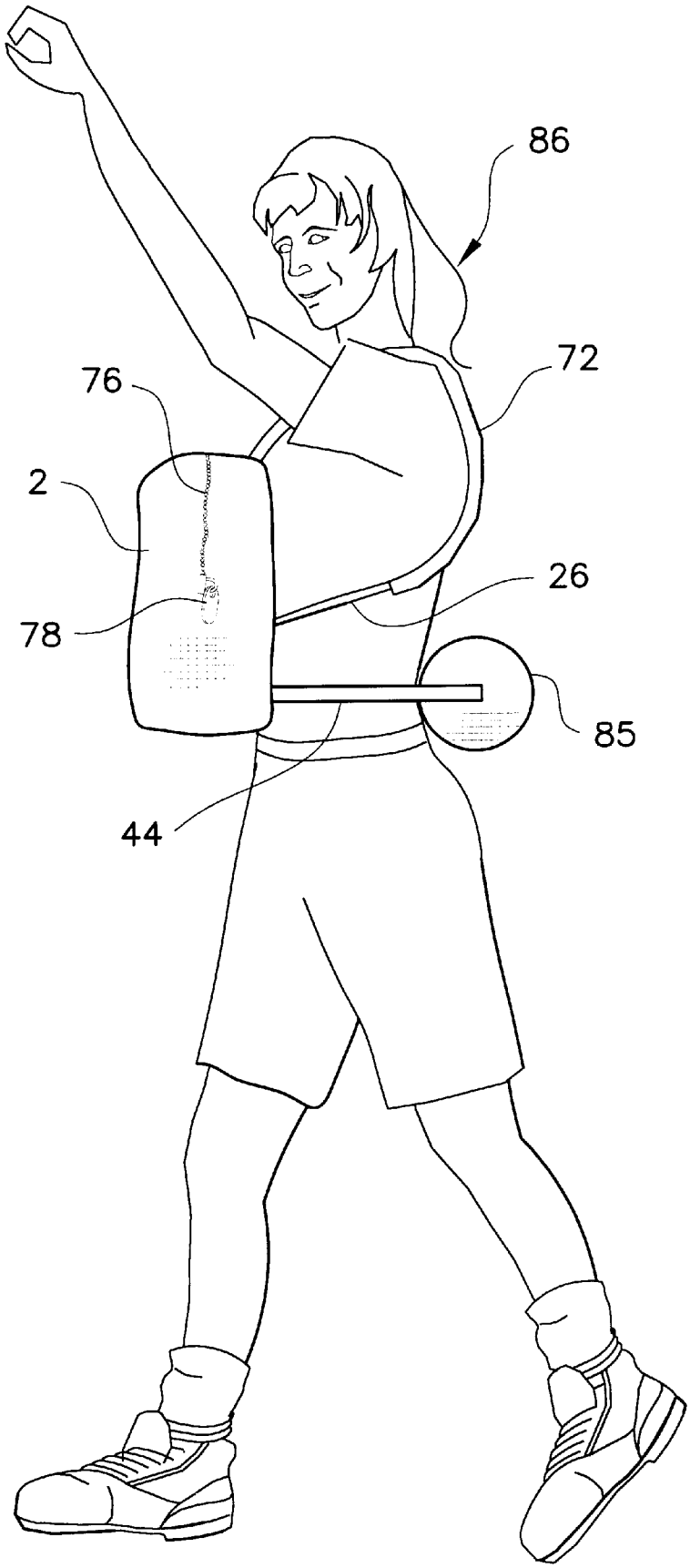
FIG. 5 is an environmental side view of the present invention depicting the lumbar roll eliciting the natural curvature of the spine and placing the pelvis into an anterior tilt.

FIG. 5 is a side view of a person wearing the front pack 2 with the lumbar roll 85. FIG. 5 depicts how the front pack 2 in conjunction with the lumbar roll 85 provides a person 86 with the proper thoracic and lumbar support which significantly enhances the correct posture thereby avoiding the detrimental consequences that result from the use of a back pack.

The front pack 2 of the present invention provides its wearer with an orthopedically correct piece of carrying gear that can be donned and carried comfortably for an extended period of time. Therefore, individuals with chronic back problems or other back maladies can enjoy both the psychological and physical benefits of hiking and other related outdoor activities. The front pack 2 of the present invention with its unique and novel features and characteristics also possesses features and characteristics common to carrying gear donned on the upper torso of a person. Consequently, the front pack 2 of the present invention can be worn on a person's back as well, although, the therapeutic benefits of the present invention are derived from wearing the pack in the front. However, when the present invention is worn on an individual's back instead of in front, the lumbar roll ? should be placed at the bottom of the pack 2 to help maintain proper posture in the lumbar region of the spinal column.

It should be understood by those skilled in the art that various modifications and adaptations of the present invention as well as alternative embodiments of the present invention may be contemplated. The preferred embodiments of the present invention disclosed herein are intended to be illustrative only and are not intended to limit the scope of the invention. It is to be understood that the present invention is not limited to the sole embodiments described above, but encompasses any and all embodiments within the scope of the following claims.

I claim:

1. A front pack for carrying personal belongings, said front pack comprising:

a front piece and a back piece each having a bottom section divided into a lower left portion and a lower right portion, a middle section, a top section divided into an upper left portion, and an upper right portion, each bottom section joined together by stitching, and at least one zipper for completely and conveniently closing said middle section and said top section, thereby defining a pack with a closure;

a first and a second adjustable shoulder support, wherein each of the shoulder supports has an upper part and a lower part, said upper part having padding, said upper part of said first shoulder support secured at said upper left portion, and said lower part has a double loop buckle attached, said lower part stitched to said lower left portion, and, said upper part of said second shoulder support secured at said upper right portion, and said lower part has a double loop buckle attached, said lower part stitched to said lower right portion;

wherein said lower part couples with the upper part by said double loop buckle to permit shortening of said shoulder support, said shoulder support retaining a shortened position once the pulling is relaxed; and means for fastening said pack around a wearer's waist, wherein said means includes a lumbar roll of removable padding.

2. The front pack according to claim 1, including:

a hook and loop fastener formed as a loop attaching to the front piece of said pack.

3. The front pack according to claim 1, further comprising user operated alarm means stored within said pack.

4. The front pack according to claim 3, wherein said alarm means is a whistle fixedly attached to said pack.

5. The front pack according to claim 1, wherein said means for fastening said pack around the wearer's waist region is a pair of waist straps, each of said waist straps extending transversely when in use;

each said waist strap includes a fixed end and a second free end, wherein said fixed end attaches to a lower edge of said pack and said second free end cooperates with a buckle portion, each of said buckle portions engaging and snapping to one another to secure said straps.

6. The front pack according to claim 5, wherein said pair of said waist straps has said lumbar roll.

7. The front pack according to claim 1, further including a bilaterally accessible insulated pouch attached to said front piece of said pack sized to receive a wearer's hands; and a hook and loop fastener for sealing the bilateral entrances of said pouch.

8. The front pack according to claim 1, further including a cellular phone pocket attached to said front piece; a key ring holder, a pen holder and a removable pocket with a zipper closure.

9. The front pack according to claim 1, further including a removable padded seat cushion that is affixed to a rear interior surface of said front pack.

10. The front pack according to claim 1, further including a reflective lining for visibility in the dark attached to each of said shoulder supports.

* * * * *